US005178397A

United States Patent [19]

Brine, Jr.

[11] Patent Number: 5,178,397

[45] Date of Patent: Jan. 12, 1993

[54] LACROSSE STICK HEAD FRAME

[75] Inventor: William H. Brine, Jr., Hanover, N.H.

[73] Assignee: Sports Licensing, Inc., Hanover, N.H.

[21] Appl. No.: 846,513

[22] Filed: Mar. 4, 1992

[51] Int. Cl.[5] ..... A63B 59/02

[52] U.S. Cl. ..... 273/326

[58] Field of Search ..... 273/326, 73 R, 73 A, 273/73 D

[56] References Cited

U.S. PATENT DOCUMENTS

| | | | |
|---|---|---|---|
| 3,086,777 | 4/1963 | Lacoste | 273/73 |
| 3,473,806 | 10/1969 | Patterson | 273/326 |
| 3,905,088 | 9/1975 | Tucker et al. | 273/326 |
| 4,034,984 | 7/1977 | Crawford et al. | 273/326 |
| 4,138,111 | 2/1979 | Rule | 273/326 |
| 4,358,117 | 11/1982 | Deutsch | 273/326 |

FOREIGN PATENT DOCUMENTS

| | | | |
|---|---|---|---|
| 2307942 | 9/1973 | Fed. Rep. of Germany | 273/73 |

*Primary Examiner*—William H. Grieb
*Attorney, Agent, or Firm*—Barry R. Blaker

[57] ABSTRACT

A lacrosse stick head frame is disclosed having improved side wall lace mounting tabs from which a ball pocket is suspended in a precisely tunable and stable manner. The tabs include features which protect the side wall lace from ball contact abrasion and wear as well as precisely locating and securing the side wall lace and the ball pocket suspended therefrom to the frame.

7 Claims, 2 Drawing Sheets

LACROSSE STICK HEAD FRAME

BACKGROUND OF THE INVENTION

The present invention relates broadly to lacrosse stick constructions and is more particularly concerned with a lacrosse stick head frame having improved side wall lace mounting tabs.

The game of lacrosse is generally considered as the oldest team contact sport of North American origin. Historical evidence suggests that the game was played by various Indian tribes, such as the Iroquois and Hurons, in the 15th century. It is generally accepted that the original purpose of the sport of lacrosse was to physically and emotionally condition Indian warriors preparatory to combat or, in some instances, to itself function as a game forum for settling of tribal differences. While the equipment utilized in the sport of lacrosse has, of course, evolved substantially over the years, one all-important piece of equipment whose basic constructional elements have remained constant is the lacrosse stick. A lacrosse stick comprises an elongate stick or shaft having affixed to one end thereof a head in the nature of a frame defining an opening and a ball pocket composed of mesh or webbing suspended within the opening and being secured to the frame. In recent years, with the decreasing availability of high grade ash or hickory and the woodworking skills necessary to form and fabricate lacrosse sticks having one-piece wooden stick/head frame structures, it has become commonplace to fabricate the head frame components thereof by molding of tough synthetic thermoplastic materials.

In U.S. Pat. No. 4,034,908, to Crawford et al., issued Jul. 12, 1977, there is disclosed a double-walled synthetic lacrosse stick head frame having a plurality of spaced apart mounting tabs extending inwardly from the upper edge of each of the side walls thereof. Each side wall mounting tab is disclosed to comprise a lace-receiving mounting hole therethrough, the lacing utilized to suspend the ball pocket mesh or webbing from the head frame being simply reeved serially from one hole to the next of the tab array. One problem associated with this type of mounting tab arrangement is that the ball pocket mesh or webbing can not be precisely adjusted and secured to the head frame in order to suit a player's particular needs. Moreover, the suspension lacing can move through the tab mounting holes, thereby undesirably altering the geometry and playing characteristics of the stick during the course of play.

In U.S. Pat. No. 4,138,111, to Rule, issued Feb. 6, 1979, there is disclosed another lacrosse stick head frame whose side walls each comprise plural spaced apart mounting tabs for mounting of the ball pocket mesh or webbing. In this patent, however, an improved mounting tab design is disclosed wherein, in addition to the usual lace-receiving mounting hole therethrough, said tab also comprises a locating means in the form of a peripheral groove or notch provided in the free end or apex of the tab, said groove or notch extending in a direction generally parallel to the mounting hole of the tab. Utilizing this form of mounting tab, the side wall lace is reeved through each tab mounting hole and then looped and tied over the locating means groove or notch of that tab before continuing on to the next tab. Using this combination of tab design and lacing scheme, a player is enabled to precisely tune the ball pocket mesh or webbing as it is being secured to the frame by suspending it from the side wall laces. Moreover, by looping and tieing the side wall laces to the mounting tabs the tuned pocket remains stable throughout the course of play. In a preferred embodiment the mounting tabs are disclosed to be secured to the bottom edge of the head and depend angularly downwardly therefrom at a slight angle. This arrangement is said to deepen the pocket suspended from the side wall lacing, which is desirable from the standpoint of playability of the stick, and is further said to place the mounting tabs sufficiently out of the way as to avoid interference with ball handling. While the invention of the Rule patent does provide the principal benefits asserted therefor, namely, to provide a stable, tunable pocket, nevertheless, certain problems have been noted therewith. Firstly, the necessity to loop and tie the side wall lace at each of the plural mounting tabs constitutes a relatively arduous and time consuming task. Secondly, it has been noted that the side wall laces of lacrosse stick head frames having the mounting tab construction of the Rule patent tend to be subject to considerable wear and abrasion due to ball contact therewith during play. This, of course, requires relatively frequent replacement of the side wall laces, along with the usual remounting, readjustment and retuning of the ball pocket mesh or webbing with each such replacement of the side wall laces.

In accordance with the present invention, the aforementioned problems have been eliminated or, at the least, substantially ameliorated.

OBJECTS OF THE INVENTION

It is a principal object of the invention to provide a lacrosse stick head frame having side wall mounting tabs of novel and functionally beneficial construction.

It is another object of the invention to provide a lacrosse stick head frame having side wall mounting tabs of a construction which facilitates tuning of a pocket suspended therefrom by means of side wall laces while mitigating against abrasion and wear of said side wall laces due to ball contact therewith.

It is yet another object of the invention to provide a lacrosse stick head frame having side wall mounting tabs of a construction which simplifies and facilitates locking of the side wall laces thereto.

Other objects and advantages of the present invention will in part be obvious and will in part appear hereinafter.

SUMMARY OF THE INVENTION

In accordance with the invention there is provided a lacrosse stick head frame having a pair of spaced apart, generally opposed, corresponding side walls. Extending inwardly from each side wall into the open area defined therebetween are a plurality of spaced apart mounting tabs defining an array of anchoring stations for a side wall lace, each said mounting tab having a front face and a back face. Each tab, which is preferably integrally secured to the back edge portion of the side wall, comprises a side wall lace-receiving aperture running from the front face through the back face thereof. The front face of each tab additionally comprises a channel of sufficient size and depth to receive the entire cross section of a side wall lace therewithin, said channel being coextensive with said aperture and running transversely therefrom through the free end or apex of the tab. A side wall lace for suspending the side portion of the ball pocket mesh or webbing is reeved through the channel and aperture of each sidewall mounting tab and looped about itself to secure it in a fixed position relative to the tab and to thereby stabilize the thusly suspended ball pocket within the head frame.

DESCRIPTION OF THE PREFERRED EMBODIMENTS

Figure 1:
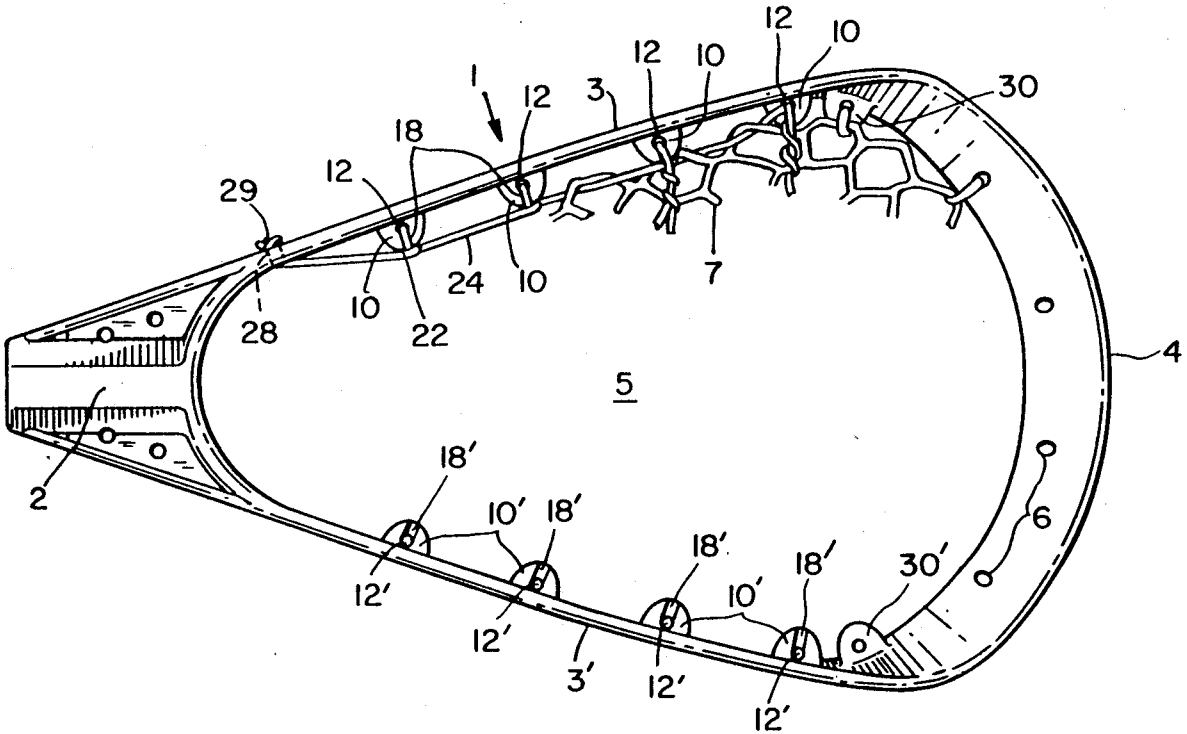
FIG. 1 hereof,is a front plan view of a lacrosse stick head frame in accordance with the invention showing a portion of the ball pocket mesh or webbing forming part of the completed head suspended from the side wall mounting tabs by means of a side wall lace.

Referring now to the drawings hereof, wherein like reference numerals refer to like structures, the lacrosse head frame 1 broadly comprises a shank end portion 2 adapted to be attached to an elongate stick element (not shown) and from which shank end portion 2 there extends outwardly a pair of spaced apart, generally opposed, corresponding side walls 3 and 3'. The outboard ends of the side walls 3 and 3' are bridged by a convexly arcuate end wall 4, thereby to complete the basic head frame 1 structure which defines an open area 5 therewithin wherein a ball pocket composed of mesh or webbing 7 is disposed and suspended from the side walls 3 and 3' of said frame.

Figure 2:
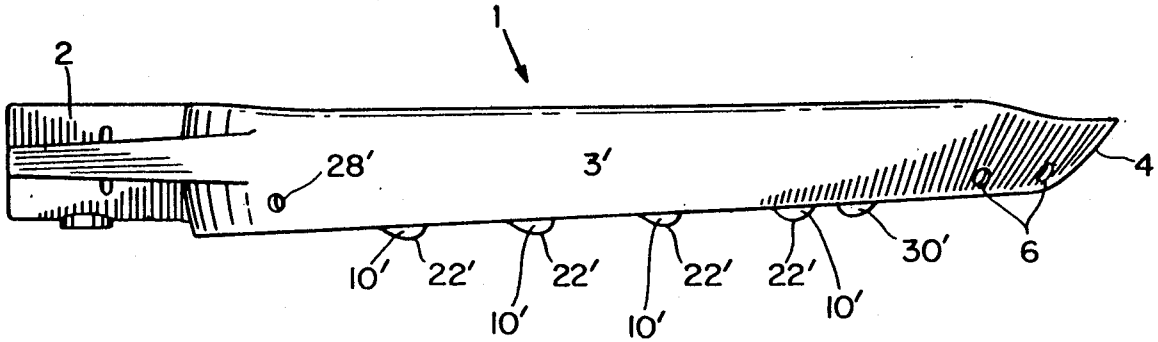
FIG. 2 is a side view of the lacrosse stick head frame of FIG. 1.

Those of skill in the art will recognize that the geometry of the particular head frame 1 expressly depicted in FIGS. 1 and 2 hereof is adapted for the attack or midfield player positions of the sport. Thus, the side walls 3 and 3' are shown to project outwardly from the shank end portion 2 at a divergent angle, thereby to define a distinctly triangular shape. However, it will also be recognized that lacrosse head frames for the defense and goal player positions, which are also within the ambit of the present invention, are of substantially more oblong geometry, but are also possessed of a pair of generally opposed, spaced apart, corresponding side wall elements.

Spaced along the length of the interior surface of each of the side walls 3 and 3' and secured thereto are a plurality of mounting tabs 10 and 10', said mounting tabs each extending inwardly into the open area 5 defined by the frame 1 in a direction generally toward the opposite side wall 3 or 3', as the case may be. Said tabs are secured in coplanar arrays to the interior surface of the side walls 3 and 3' of the frame 1 and, for purposes of maximizing the depth of the ball pocket suspended from the frame, are preferably affixed to the side walls 3 and 3' as close to the back edges 20 and 20' thereof as is practicable. It is also preferred that said tabs 10 or 10' depend at a shallow angle from their points of attachment to the side wall 3 or 3' such that their free ends 22 and 22' are positioned in a plane somewhat behind the back edges 20 or 20' of said side walls, such as is shown most clearly in FIG. 2 hereof. In this way, the depth of the ball pocket ultimately formed within the head frame 1 can be further maximized. Each of the side wall tabs 10 and 10' is provided with a side wall lace-receiving aperture 12 or 12' running through the front and back faces 14 and 16 thereof and preferably being located on the tab near the junction thereof with its associated side wall 3 or 3'.

The foregoing elements and structures of the present invention are similar in nature and function to the equivalent elements and structures disclosed in the hereinbefore cited U.S. Pat. No. 4,138,111, to Robert J. Rule, issued Feb. 6, 1979. Accordingly, for purposes of a better understanding of the present invention, the entire disclosure of said U.S. Pat. No. 4,138,111 is incorporated herein, by reference thereto.

Figure 3:
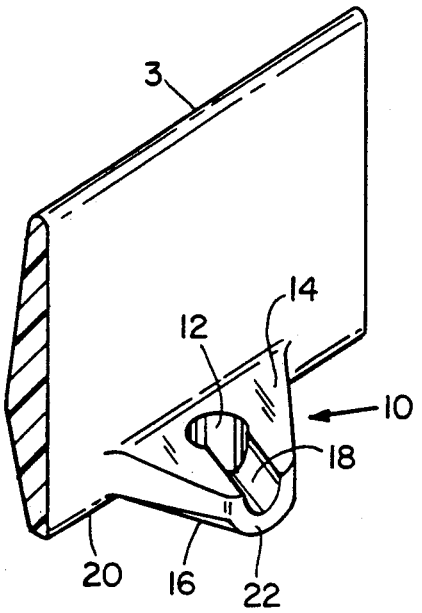
FIG. 3 is a perspective, partially sectional view of a portion of the side wall of the lacrosse stick head frame depicted in FIGS. 1 and 2, showing details of a mounting tab in accordance with the invention.
Figure 4:
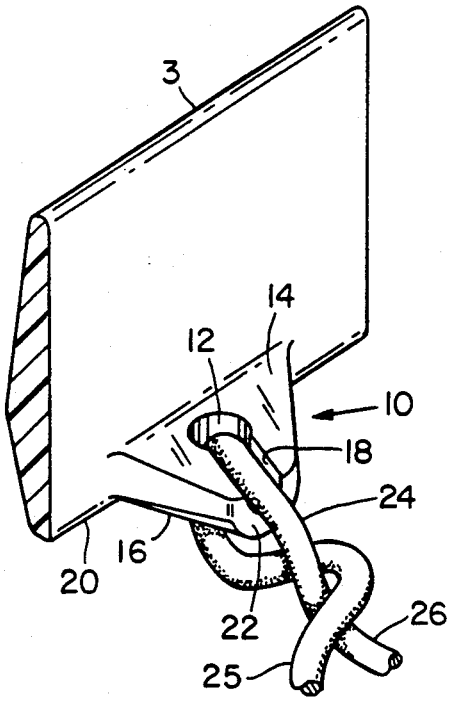
FIG. 4 is perspective, partially sectional view of the portion of the side wall of the lacrosse stick head frame shown in FIG. 3 and additionally showing suitable reeving of a side wall lace to the mounting tab for purposes of securing said lace in fixed position relative to said tab.
Figure 5:
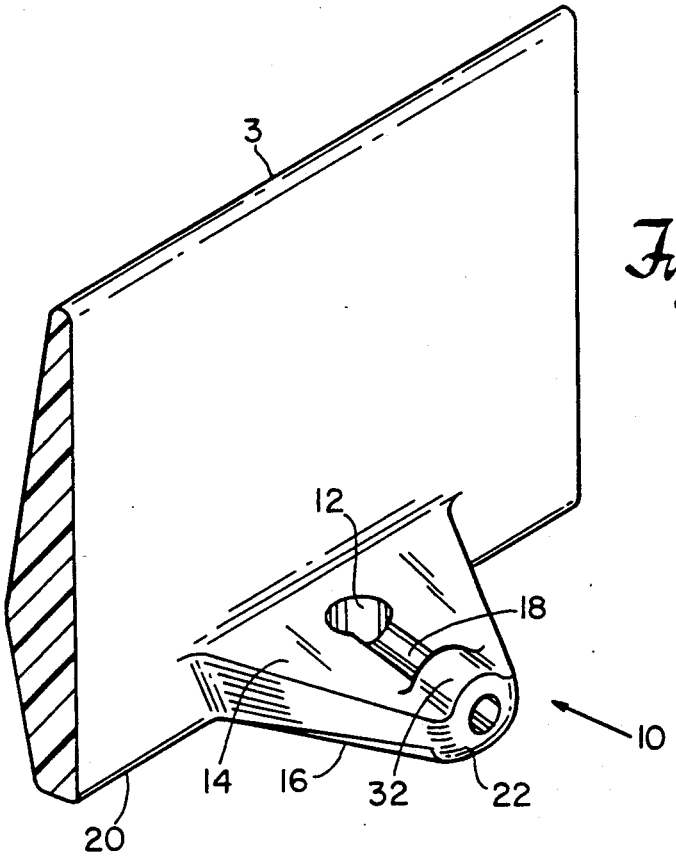
FIG. 5 is perspective, partially sectional view of a portion of a side wall of a lacrosse stick head frame showing another embodiment of a mounting tab in accordance with the invention.

The novel features of the side wall mounting tabs of the present invention can best be appreciated by reference to Figures 3 through 5 hereof, each of which figures depicts an individual side wall mounting tab 10 affixed to the side wall 3 of a lacrosse head frame 1. Accordingly, the following discussion is made with particular reference to these figures with the understanding, however, that the structural details shown with respect to the individual side wall mounting tabs 10 therein depicted are intended to be common to each of the plural spaced apart side wall mounting tabs 10 or 10' of the invention. Thus, referring to FIGS. 3 through 5 hereof, it will be seen that the front surface 14 of the mounting tab 10 comprises a channel 18 which is coextensive with the side wall lace-receiving aperture 12 thereof and runs transversely therefrom through the free end or apex 22 of the tab. As shown with clarity in FIG. 4, said channel 18 is of a breadth and depth sufficient to receive the entire cross section of a side wall lace 24 therein, thereby to afford substantial ball abrasion protection to the section of said side wall lace 24 residing therein during the course of play. Moreover, said channel 18 also functions as a locating means for the side wall lace 24, thereby providing a precise anchor point for said lace and for the ball pocket mesh or webbing 7 suspended therefrom. As can be appreciated by reference to FIG. 4, when the lace 24 is reeved through the mounting aperture 12 with a section of the standing portion 26 thereof being received in the channel 18, and the tag end portion 25 is brought under and over the standing portion 26 lying outside the channel 18, and the lace thereafter tightened and the tag end thereof cinched to a suitable anchor point located inboard of said tab 10, the lace becomes locked into the channel 18 and can not thereafter move laterally with respect thereto. Thus, in addition to its side wall lace protective function, the channel 18 also serves to precisely locate the lace with respect to the tab 10 and to lock the lace into position without the need to engage in time consuming knot tieing operations at each and every one of the anchoring stations represented by the plural spaced apart mounting tabs 10.

Referring to FIG. 1, an exemplary, but not sole, method of suspending a preformed ball pocket mesh 7 from the side walls 3 and 3' of the head frame 1 is as follows. A side wall lace 24, which may be in the nature of a monofilament or multifilament cord formed of any suitably tough natural or synthetic textile fiber material, such as nylon or polyester, is reeved through the mounting aperture 12 of the most outboard of the plurality of mounting tabs 10, that is to say, the mounting tab 10 closest to the end wall 4, and tied thereto in a secure manner. With the ball pocket mesh 7 properly positioned between the side walls 3 and 3', the side wall lace 24 is threaded first through an appropriately located hole in the edge of the ball pocket mesh 7 and thence through the aperture 12 of the next inboard mounting tab 10. After passing through said aperture 12, the tag end portion of the lace is passed under and over the standing portion thereof, as previously described, and thence downwardly through that edge hole of the mesh 7 closest to the free end 22 of said mounting tab 10. The tag end of the lace 24 is passed upwardly through the next inboard edge hole of the mesh and thence through the aperture 12 of the next inboard mounting tab 10. These steps are repeated serially until the lace 24 is passed through the aperture 12 of the most inboard of the side wall mounting tabs 10, namely the side wall mounting tab 10 closest to the shank portion 2, whereupon the tag end portion is once more passed under and over the standing portion. Then the tag end portion of the lace 24 is brought to a suitable anchor point inboard of the most inboard of the mounting tabs 10, which anchor point can conveniently take the form of an aperture 28 running transversely through side wall 3 at about the junction thereof with the shank end portion 2 of head frame 1. The tag end of the side wall lace 24 is threaded through the aperture 28 to bring it to the exterior of the head frame 1, tightened sufficiently to seat the lace 24 into each of the channels 18 of the tabs 10, and then secured in the tightened condition such as by tieing it into a simple overhand knot 29 flush with the exterior of the aperture 28. Using a similar procedure, the other side of the ball pocket mesh 7 is secured to the side wall 3'.

While not forming part of the present invention, those of skill in the art will recognize that additional standard and well known finishing operations are required to provide a finished lacrosse head. These finishing operations include securing the outboard end of the ball pocket mesh 7 to the end wall 4 and the installation of shooter strings. The techniques and modalities required to accomplish these finishing tasks are well known in the art and need not be elaborated upon herein. With respect to attachment of the outboard end of the ball pocket mesh 7 to the end wall 4, the usual mounting apertures 5 may be provided in the end wall 4 and the ball pocket mesh 7 laced directly to said apertures 5 in the usual manner. With respect to installation of the shooter strings, which are traditionally two in number and run in spaced apart relationship transversely across the outboard end portion of the ball pocket, separate mounting tabs, such as shown at 30 and 30', may be provided for anchoring the ends of the shooter strings or, if desired, the most outboard pair of the side wall tabs 10 and 10' can be utilized provided that the apertures 12 and 12' thereof are sufficiently large as to share the burden of accepting the shooter strings as well as the side wall laces.

In another preferred embodiment of the invention, referring now specifically to FIG. 5, each of the mounting tabs 10 (and 10') comprises an integral, narrow and preferably essentially flat bridge 32 disposed over the free end of the channel 18. Said bridge 32 provides additional abrasion protection to the side wall lace 24 lying within said channel 18 as well as improved security of positioning thereof.

While the invention has been described hereinabove with respect to certain embodiments thereof, it should be understood that the foregoing description is illustrative in nature and that various omissions, substitutions, changes and additions in the forms and details of the invention can be made by those of skill in the art without departing from the essential scope and spirit thereof. For example, while a suitable technique for suspending a preformed ball pocket mesh from the head frame of the invention has been described in detail, it is obvious that the invention can also be beneficially employed in consort with a traditional ball pocket composed of webbing material and created by weaving the ball pocket onto side wall laces previously installed onto the head frame. Accordingly, it is intended that the invention is to be limited only by the scope of the appended claims.

What is claimed is:

1. In a lacrosse stick head frame comprising a shank end portion, a pair of spaced apart, generally opposed corresponding side walls extending from said shank portion and an end wall bridging the outboard ends of said pair of spaced apart side walls, thereby to define a frame having an open area between said side walls, each said side wall comprising a plurality of side wall lace mounting tabs secured in a planar spaced apart array along the length of the interior of said side wall, said tabs extending into said open area, each said tab having a free end and front and back faces and having a side wall lace-receiving aperture running through said front and back faces, the improvement which comprises: the front face of each said side wall lace mounting tab comprising a side wall lace-receiving channel coextensive with said side wall lace-receiving aperture and running transversely from said aperture through the free end of said tab, said channel being of a size adapted to receive the entire cross section of a side wall lace received therein, and the free end of said side wall lace mounting tab comprising an integral narrow bridge disposed over said channel.

2. The lacrosse stick head frame of claim 1 wherein each said side wall lace mounting tab is secured to said side wall adjacent the back edge thereof.

3. The lacrosse stick head frame of claim 2 wherein each said side wall lace mounting tab is integrally secured to said side wall.

4. The lacrosse stick head frame of claim 2 wherein said side wall lace mounting .tabs depend backwardly at a shallow angle from their points of attachment adjacent the back edge of said side wall, thereby to position the free ends thereof in a plane somewhat behind said back edge of said side wall.

5. The lacrosse stick head frame of claim 1 wherein said side wall lace mounting aperture of each said mounting tab is located near the junction of said tab with its associated side wall.

6. The lacrosse stick head frame of claim 1 wherein each said side wall further includes side wall lace anchoring means located inboard of the most inboard of the array of said side wall lace mounting tabs.

7. The lacrosse stick head frame of claim 1 composed of a molded tough synthetic thermoplastic material.

* * * * *